US007712172B2

(12) United States Patent
Jones

(10) Patent No.: US 7,712,172 B2
(45) Date of Patent: May 11, 2010

(54) APPARATUS AND METHOD OF PROVIDING ADJUSTABLE SUPPORT AND MASSAGE TO A SLEEP SYSTEM

(76) Inventor: Daniel W Jones, Developed Concepts, 7113 W. 135th St., Ste. 174, Overland Park, KS (US) 66223-1238

( * ) Notice: Subject to any disclaimer, the term of this patent is extended or adjusted under 35 U.S.C. 154(b) by 734 days.

(21) Appl. No.: 11/504,406

(22) Filed: Aug. 15, 2006

(65) Prior Publication Data

US 2008/0045869 A1 Feb. 21, 2008

(51) Int. Cl.
*A61H 15/00* (2006.01)
*A47C 27/15* (2006.01)

(52) U.S. Cl. ..... 5/933; 5/926; 5/740; 601/98; 601/99; 601/115; 601/116

(58) Field of Classification Search ..... 5/933, 5/740, 655.9, 953, 925, 926; 601/98, 99, 601/102, 115, 116
See application file for complete search history.

(56) References Cited

U.S. PATENT DOCUMENTS

| | | | | | |
|---|---|---|---|---|---|
| 2,310,106 | A | | 2/1943 | Miller | |
| 2,741,780 | A | * | 4/1956 | Kimbrig | 5/711 |
| 2,781,040 | A | * | 2/1957 | Hill | 601/99 |
| 2,874,390 | A | | 2/1959 | Stone | |
| 2,874,689 | A | * | 2/1959 | Gavelek | 601/99 |
| 2,909,173 | A | * | 10/1959 | Anderson | 601/99 |
| 3,003,497 | A | | 10/1961 | Nunes | |
| 3,039,458 | A | * | 6/1962 | Hill | 601/116 |
| 3,238,936 | A | * | 3/1966 | Siedentop | 601/19 |
| 3,252,170 | A | | 5/1966 | Frye | |
| 3,523,524 | A | | 8/1970 | Wilson | |
| 3,551,924 | A | | 1/1971 | Frye, Sr. | |
| 3,664,333 | A | | 5/1972 | Hill | |
| 3,739,409 | A | | 6/1973 | Johnson | |
| 3,794,018 | A | | 2/1974 | Repko | |
| 3,830,233 | A | * | 8/1974 | Hill | 606/243 |
| 3,877,422 | A | * | 4/1975 | Heuser et al. | 601/116 |
| 3,882,856 | A | * | 5/1975 | Heuser et al. | 601/116 |
| 4,061,147 | A | | 12/1977 | Falchi | |
| 4,109,914 | A | | 8/1978 | Matsumoto | |
| 4,190,043 | A | | 2/1980 | Thompson | |
| 4,222,137 | A | | 9/1980 | Usami | |
| 4,267,610 | A | | 5/1981 | Blakeway et al. | |
| 4,458,675 | A | | 7/1984 | Nakao et al. | |
| 4,586,493 | A | * | 5/1986 | Goodman | 601/116 |
| 4,644,593 | A | | 2/1987 | O'Brien | |
| 4,656,998 | A | | 4/1987 | Masuda et al. | |
| 4,677,701 | A | | 7/1987 | Galumbeck | |
| 5,088,475 | A | | 2/1992 | Steffensmeier | |

(Continued)

*Primary Examiner*—Robert G Santos
(74) *Attorney, Agent, or Firm*—Boyle Fredrickson, S.C.

(57) ABSTRACT

A method and apparatus for a sleep system is provided. More specifically, the invention provides a method and apparatus for an adjustable mattress that allows the user to increase or decrease the firmness of the mattress. Furthermore, the adjustable mattress has zones of adjustability thereby allowing two users to adjust the firmness of the mattress of each user's zone. The adjustable mattress is also multimodal. The motorized foundation contains adjustable massaging units that may be used for physical therapy and relaxation. Likewise, the motorized foundation may be used in relax mode to assist in obtaining sleep and awaken mode to gently awake the user by the stimulation of the adjustable mattress.

28 Claims, 4 Drawing Sheets

U.S. PATENT DOCUMENTS 5,165,390 A 11/1992 Fleetwood
5,233,712 A 8/1993 Jurus et al.
5,323,499 A 6/1994 Chan
5,394,577 A 3/1995 James et al.
5,443,439 A 8/1995 Ohshita
5,504,952 A 4/1996 Ovadia
5,526,543 A 6/1996 DiMatteo
5,669,094 A * 9/1997 Swanson ..... 5/740
5,688,228 A 11/1997 Lin et al.
5,708,996 A 1/1998 Marenco
5,792,080 A 8/1998 Ookawa et al.
5,862,550 A 1/1999 Cosani
5,896,604 A 4/1999 McLean
5,960,496 A * 10/1999 Boyd ..... 5/722
6,003,178 A 12/1999 Montoni
6,159,574 A * 12/2000 Landvik et al. ..... 428/71
6,161,234 A 12/2000 Amann
6,190,338 B1 * 2/2001 Arndt ..... 601/115
6,256,821 B1 * 7/2001 Boyd ..... 5/722
6,541,094 B1 * 4/2003 Landvik et al. ..... 428/71
6,684,433 B2 2/2004 Giori et al.
6,799,342 B1 10/2004 Jarmon
6,807,698 B2 10/2004 Torbet et al.
6,952,852 B2 10/2005 Reeder et al.
7,081,098 B2 7/2006 Kim
7,273,460 B1 * 9/2007 Nan et al. ..... 601/98
7,469,437 B2 * 12/2008 Mikkelsen et al. ..... 5/740
7,572,240 B2 * 8/2009 Nan ..... 601/98
2008/0045869 A1 * 2/2008 Jones ..... 601/98
2009/0293199 A1 * 12/2009 Landvik et al. ..... 5/740

* cited by examiner

APPARATUS AND METHOD OF PROVIDING ADJUSTABLE SUPPORT AND MASSAGE TO A SLEEP SYSTEM

FIELD OF THE INVENTION

This invention relates to a bed for resting and sleeping. More specifically, the invention provides a method and apparatus for an adjustable mattress that allows the user to increase or decrease the firmness of the mattress. Alternatively, the adjustable mattress has zones of adjustability thereby allowing two users to adjust the firmness of the mattress of each user's zone. The adjustable mattress is also multimodal. The motorized foundation may contain adjustable massaging units that may be used for physical therapy and relaxation. Alternatively, the motorized foundation may be used in relax mode to assist in obtaining sleep and awaken mode to gently awake the user by the stimulation of the massaging mechanism.

BACKGROUND OF THE INVENTION

Sleeping mattress and design are typically of three forms: foam and batting, water bladders, or air bladders. A traditional mattress and foundation combination utilizes a box spring having a series of vertical springs arranged along the entire width and length of the box spring. These provide support for the mattress that is placed on top. The mattress may have various internal components such as vertical springs, wiring, cording, and soft batting materials such as cotton and foam. The firmness of the mattress is a function of the combination of compressive properties of each material. A firm mattress may utilize stiff vertical springs and a dense foam and cotton batting on top to form a "pillow-top". One limitation of these traditional mattress and box-spring combinations is that the firmness of the mattress system can only be achieved by replacing the components. Likewise, the firmness of the mattress changes with age of the materials and worn areas or depressed areas may develop.

Water bladders, or more commonly known as waterbeds utilize a bladder, which is filled with water. The firmness of the bed is controlled by the amount of water in the bladder and resulting fluid pressure. Various bladder designs are also available which provide wave support to prevent the water in the bladder from creating a wave. Also multiple bladders may be used to provide various zones of firmness. Like the traditional mattress and box-spring design, adding or removing water may only change the firmness of the water bladder bed. Water has a disadvantage over conventional mattress in that when weight is applied to one location, the displaced water raises the bladder in another area. Another disadvantage of these mattresses is the fact that the bladder can be compromised resulting in the water leaking from the mattress.

The third most common bed configuration is the air mattress. Like a waterbed, the air mattress utilizes a bladder or multiple bladders filled with air. One type of airbed configuration allows two users to adjust each side of the bed independently. The user may adjust the firmness of the bed by pumping air into or removing air from the bladder. The most common types of airbeds typically do not allow the user to adjust the firmness along the length of the bladder such as firmer along the area of the user's lower back is positioned and softer at the head of the bed. A multiple bladder system, using more that one bladder per sleeping area could be used to provide adjustable comfort. However, bladder systems, both air and water, have a disadvantage over conventional mattress in that when weight is applied to one location, the displaced air or water raises the bladder in another area. Thus, if the bladder system is set as soft, a heavy person's mass displaces more air or water at the heaviest areas such as the hips, which raises the head or foot area.

Another alternative of conventional and air or water bladders, is the foam bed. These foam systems may be composed of polyurethane or urethane foams. These mattresses may be used with a conventional box spring and the mattress itself may utilize foam of different densities along the length of the mattress or even spring systems. A disadvantage of the foam bed is that firm of the mattress cannot be adjusted and the foam subject to fatigue and loss of its rigidity.

Recent developments in foam systems include those mattress pads of visco-elastic foams such as Contour-Foam™, Tempurpedic®, Isotonic™ and similar foams. These may be used on top of traditional, air or waterbed to increase the comfort of the bed. Also, new mattress systems use the visco-elastic as a top portion with various foam bases or conventional spring systems. These types of foams conform to the body and provide reduced pressure support. A disadvantage of these systems is that they are not adjustable. Like a traditional mattress, both the visco-elastic foam and urethane foam mattresses need to be flipped and rotated to prevent localized fatigued areas.

Hospital style beds often use the visco-elastic foam to help prevent pressure sores (subcutaneous ulcers) on bed-confined patents. Most hospital beds have adjustable positions, however, they do not provide adjustable firmness along the length of the bed. Hospitals also utilize air mattress systems that may utilize an active air pump to maintain the pressure in the mattress. These air pumps are typically noisy and often disturbing to the patient.

Although the above bed systems provide various methods of support, they lack the ability to provide adjustability of firmness along the length of the bed (i.e. from foot to head). Furthermore, the above bed systems provide only one function—a place to sleep. Thus, it is desirable to have a sleep system that provides for adjustable firmness at multiple locations along the mattress. Furthermore, it is desirable to have a system that provides alternate functions such as compressive massaging. Beside the relaxing properties of massage to aid sleep, massage is also beneficial to persons confined to bed for the relief of localized pressure and increase blood flow to the area of pressure. Likewise, it is desirable to have a bed system that provides an alternative means of wakening such as vibration or even a gentle massage. This type of awaking means is also desired by the hearing impaired.

Previous attempts have been made to provide for automatic massage on a table or bed like foundation. U.S. Pat. No. 3,503,524 by Wilson, utilizes a table platform with foam placed on top. Massaging rollers on a conveyor belt system is located beneath the surface of the table. To make contact with the person lying on the table, a slot having a width greater than the roller is cut into the table and foam and the massaging roller protrudes through the slot. The conveyor belt utilizes multiple rollers, but only provides massage in the area of the slot in the table. As disclosed, the table can take the form of a bed by placing a cushion insert in the slot. This requires the user to get up from the table, retrieve the cushion and place it into the slot. This step is often undesirable such as the case when the user desires the massage to help him or her to relax, reduce tension and assist the person in obtaining sleep. Likewise, if the user falls asleep on the table with the massaging roller intact, the person may roll onto the roller or respond to the roller by moving over. The location of the roller or element is very undesirable in a bed. The cushion for the slot would need a stiff backing to prevent the user's weight from compressing it to prevent the cushion from molding to the belt and roller below. Thus, a massaging bed that automatically converts into a bed without the user getting out or having to move over on the bed to replace a cushion in the bed is desired.

Advances have been made in massaging chairs and recliner models are available. These reclining chairs can provide a very comfortable massage, but also carry a warning that states that the chair is not for sleeping in. Besides the fact that these chairs do not have significant padding between the massaging rollers or massaging heads. This provides significant contact or force into the muscle of the user. Massage chairs are designed to support the user's weight at the seat pan or the chair, arm rests and leg rests. These areas will have more padding and substructure and the quality of the massage is typically less than those areas without the extra padding. These areas requiring padding present problems to the designer. The padding used in the chair must be able to withstand the repetitive action of the massagers that create friction, heat and wear of the padding. In fact, U.S. Pat. No. 7,004,916 to Dehli, recognizes that it is desirable to have chair massager "that preferably does not rattle with age, does not wear away the chair fabric at a considerable rate, and is safe to the user." Likewise, U.S. Pat. No. 6,881,195 to Wu also discusses the need for a fabric for a chair massager that can withstand the wear of the massage rollers, especially in the hollow area of the chair that does not contain significant padding.

SUMMARY OF THE INVENTION

The present invention provides a method and apparatus for a multifunctional and multidimensional adjustable firmness sleep system that provides multiple sleep modes, relaxation, sleep and gentle awakening.

One embodiment utilizes a foam mattress placed on a multimodal and powered foundation with a timing device having a user interface.

A second embodiment utilizes foam and powered foundation having pistons and rollers to provide adjustable firmness and massaging and vibration.

A third embodiment utilizes foam and air solenoids to achieve adjustable firmness and provide massaging and vibration.

A fourth embodiment utilizes foam and a powered foundation with pneumatically controlled actuators.

A fifth embodiment utilizes foam and alternative mechanical methods of achieving adjustable firmness and massaging and vibration.

A sixth embodiment utilizes an algorithm to progressively reduce the massaging action to assist in obtaining sleep. This embodiment may alternatively use air noise or other mechanically produced white noise to further assist in obtaining sleep.

Other aspects and advantages of the present invention will be apparent from the following detailed description of the preferred embodiments and the accompanying drawing figures.

DETAILED DESCRIPTION OF THE INVENTION

The invention may be embodied in various forms; however, the invention is described with respect to the following embodiments.

Figure 1A:
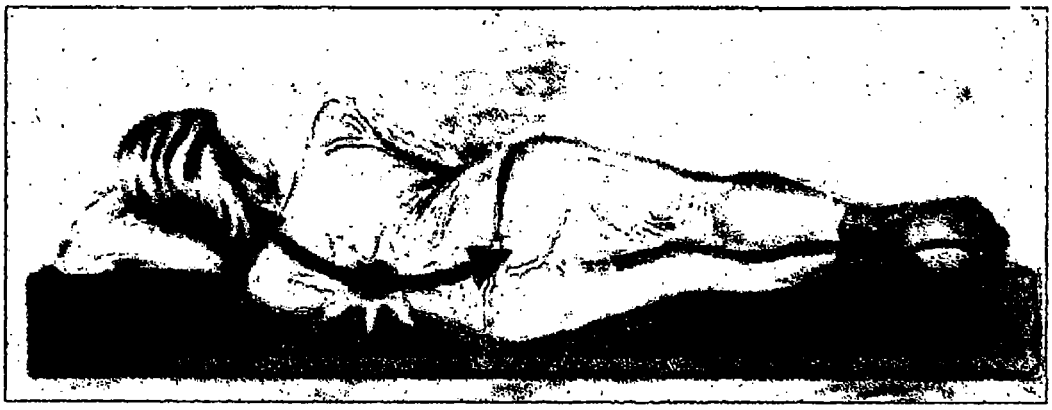
Fig. 1A (Prior Art)
FIGS. 1A-C each illustrate a side plan view of a prior art bed respectively illustrating a conventional, air and water bladder mattress system.
Figure 1B:
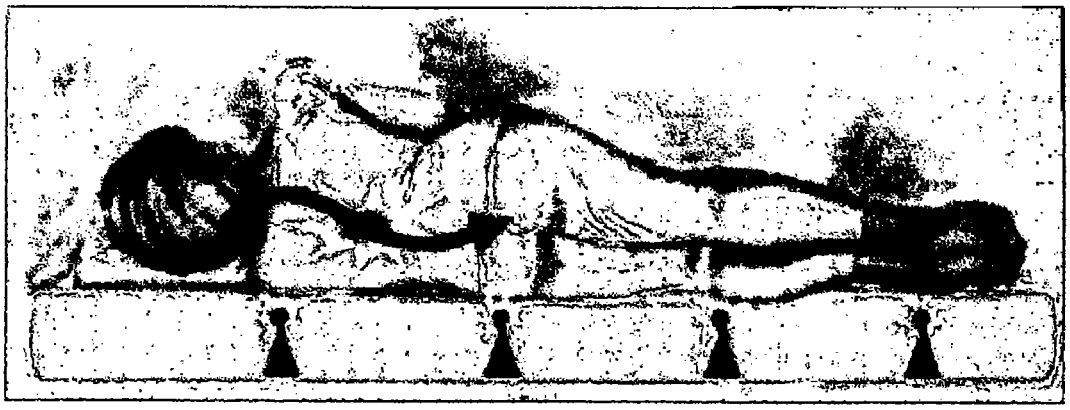
Fig. 1B (Prior Art)
Figure 1C:
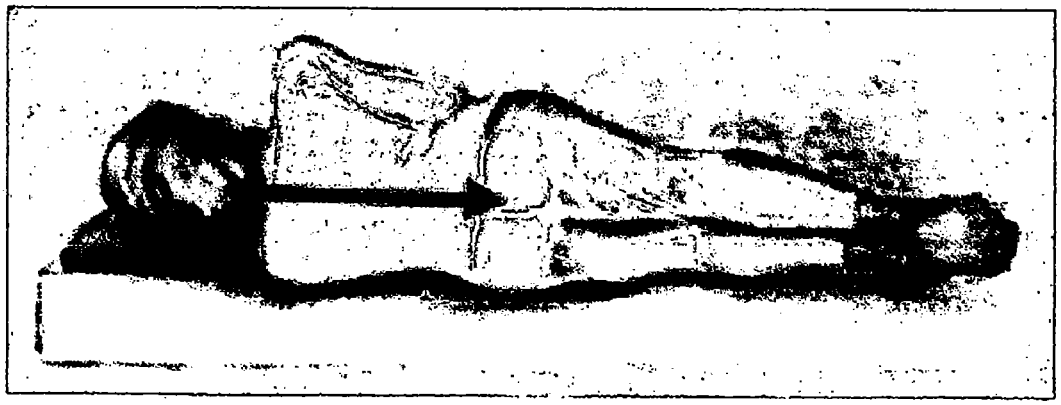
Fig. 1C (Prior Art)

Prior art bed systems typically use a mattress having some type of foam or other foam and cotton batting materials which may not provide adequate support for the user. FIG. 1A illustrates a foam or foam and cotton batting mattress that does not provide adequate support. The heaviest areas of the user compresses the foam more than the lighter areas. As illustrated in FIG. 1C, the user's spine is out of alignment placing pressure the user's shoulder, neck and lower back. In contrast, a mattress that is too stiff provides inadequate support of the contours of the user's body and places pressure on the user's shoulder, hip, knee and ankle as illustrated in FIG. 1B. The best possible posture for sleep is shown in FIG. 1C. The user's spine is in natural alignment and the mattress evenly supports the user's body.

Figure 2:
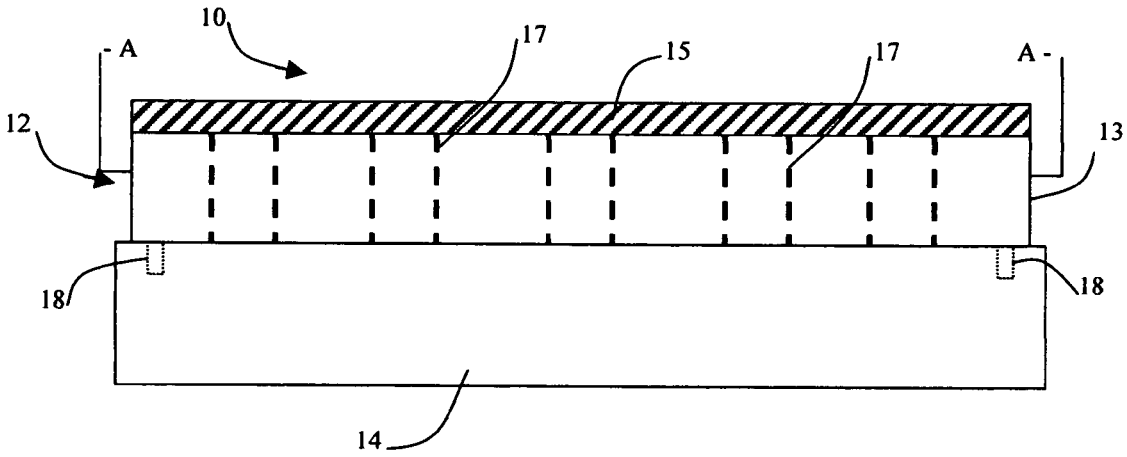
FIG. 2 is a side plan view of a multimodal sleep system constructed in accordance with the present invention.
Figure 3:
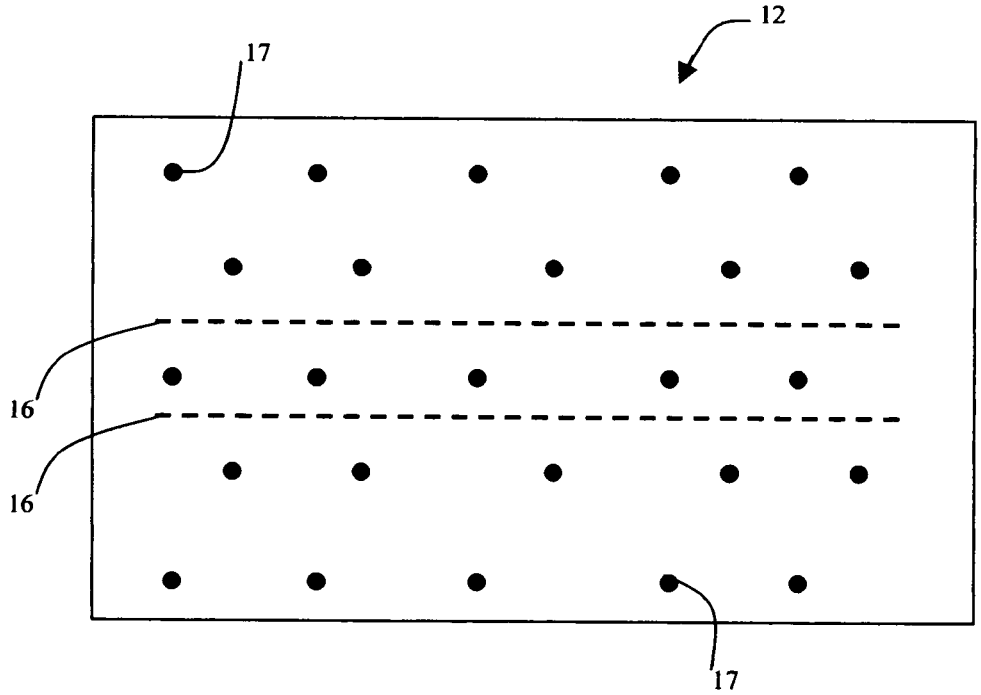
FIG. 3 is a plan view of a mattress of the sleep system of FIG. 2 along line A-A of FIG. 2.

Turning to FIG. 2, one embodiment of sleep system 10 utilizes a visco-elastic foam mattress 12 and a powered foundation 14. In one embodiment, mattress 12 is composed of a mattress body 13 and mattress topper 15. Foam mattress body 13 contains slits 16 that appear like a thin cut in the foam mattress body 13. FIG. 3 illustrates the slits 16 that originate from the underside of mattress body 13 and mates with apparatus (not shown) contained in powered foundation 14. Returning to FIG. 2, restraining member 17 is utilized to maintain a nearly flat surface on the top of mattress 12. Restraining member 17 may be composed of various cording material such nylon, wire, plastic, cotton or similar materials having rigidity. Mattress jacket (not shown) covers mattress 12 and encases mattress body 13 and mattress topper 15. Alignment guides in the form of pins 18 are used to ensure that mattress 12 is aligned with powered foundation 14 and is received in a corresponding hole in powered foundation 14.

Illustrated in FIG. 3 is a cutaway view along plane A-A of FIG. 2 of mattress 12 illustrating the slits 16 that transverse the thickness of foam mattress body 13 from the bottom of foam mattress body 13. Slit 16 opens when the massaging apparatus 21 (not shown in FIG. 3) travels vertically from powered foundation 14 through slit 16 to mattress topper 15. Slit 16 is substantially closed at all times and is made by cutting a slit in foam mattress 12. In contrast, a slot, where foam is removed from the cut, cannot close and leave an interrupted surface. When force is applied to mattress topper 15 with a slotted submattress, that area of the mattress containing a cut, topper 15 sags in the areas above the slots. Therefore, slit 16 is a preferred method of cutting foam mattress 12. Also shown is restraining member 17. Multiple slits 16 may be used along foam mattress 12 to obtain the desired massaging travel pathways or similar function.

Figure 4:
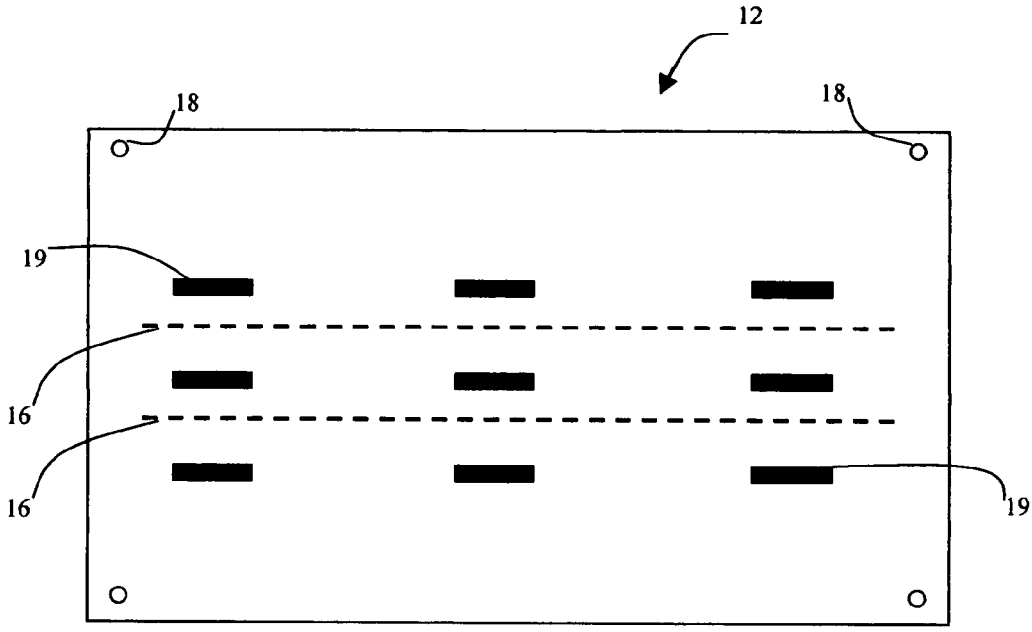
FIG. 4 is a bottom plan view of mattress having slots for receiving massagers.

The bottom of foam mattress 12 is illustrated in FIG. 4. The opening of slits 16 are shown and various numbers of slits 16 may be used. Also seen in FIG. 4 are loop and hook fasteners 19, such as Velcro®. These provide an additional attachment point along with pins 18 to secure mattress 12 to powered foundation 14. However, various fastener systems may be used to secure mattress 12 to powered foundation 14. Slits 16 may be are lined with material containing polytetrafluoroethylene (Teflon®), silicon, tungsten disulfide or other low friction coating to allow the massaging members (not shown) to travel upward through slits 16 to mattress topper 15.

Figure 5:
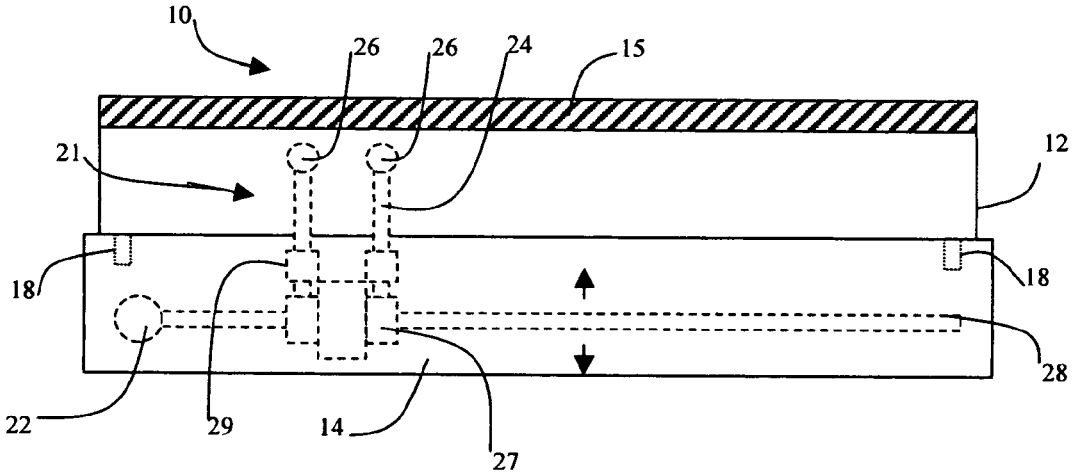
FIG. 5 is a portion of a cross-sectional view of the side of the sleep system powered foundation illustrating one set of massagers and its drive system of one embodiment.

An alternative sleep system 10 is shown in FIG. 5. Mattress 12 sits on top of power foundation 14 as illustrated. Massage actuators 24 are received in mattress slits 16 (shown in FIG. 4) of foam mattress 12. Massager 26 is also received in slit 16 of foam mattress 12 and provides compressive massage as they move along mattress 12 in slits 16. As stated above, slits 16 may be are lined with a fabric containing a low friction coating or fabric impregnated with a low friction material. Foam mattress 12 is composed of open-cell, visco-elastic memory foam and may be composed of multiple layers such as 3 pound density foam submattress (the portion of mattress 12 containing slits 16) and a denser foam, 4 or 5 pound density, for mattress topper 15. As massaging apparatus 21 travels upward from powered foundation 14, massaging apparatus 21 splits open slit 16. Slits 16 are substantially closed when massaging apparatus 21 is retracted in powered foundation 14 or is passed by and foam mattress 12 appears to be a solid mattress. Furthermore, when fully retracted, the resistive compressive properties the slitted submattress of foam mattress 12 remains virtually identical to that of a non-slitted foam mattress of identical foam type and density. Vibrating motors 29 provides vibrating action to massager 26. Likewise, y-axis motor 27 provides massager actuator 24 with up and down massaging action. Mattress topper 15 is an uninterrupted surface and has sufficient foam above massager 26 to provide comfort to the user. Mattress topper 15 may also contain a low friction material or coating where slits 16 stop at mattress topper 15 to reduction wear of mattress topper 16 and reduce frictional heat.

Figure 7:
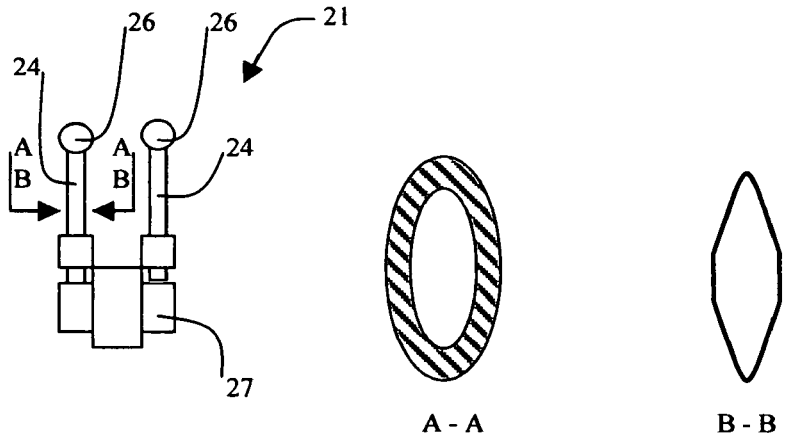
FIG. 7 is a cutaway view of a massaging member taken along line A-A and B-B of the side view of the massager actuator.

FIG. 7 illustrates massaging apparatus 21 and a cross-sectional view of massage actuator 24. Massage actuator 24 has an aerodynamic cross-sectional shape as such as those shown in FIG. 7, view A-A and B-B. These shapes help assist in the opening of slits 16 as the massage actuator 24 travels to massage locations and close slit 16 behind it. Section B-B is shaped such that the leading and trailing edges are curved to open slit 16 and separates as the foam as it travels pasts the side of massage actuator 24 to progressively close. Low friction coatings may be added to massage actuator 24 to reduce friction and abrasion. Various designs of massage actuator 24 may be utilized. The section shown in B-B separates the slit with low friction and the side shapes, the angled and flat surfaces to minimize the high-pressure regions and therefore reduce the fatigue wear to slits 16. Slits 16 must remain substantially closed to keep the uniformity of foam mattress 12. If slits 16 are allowed to stay open, foam mattress 12 collapses.

Figure 6:
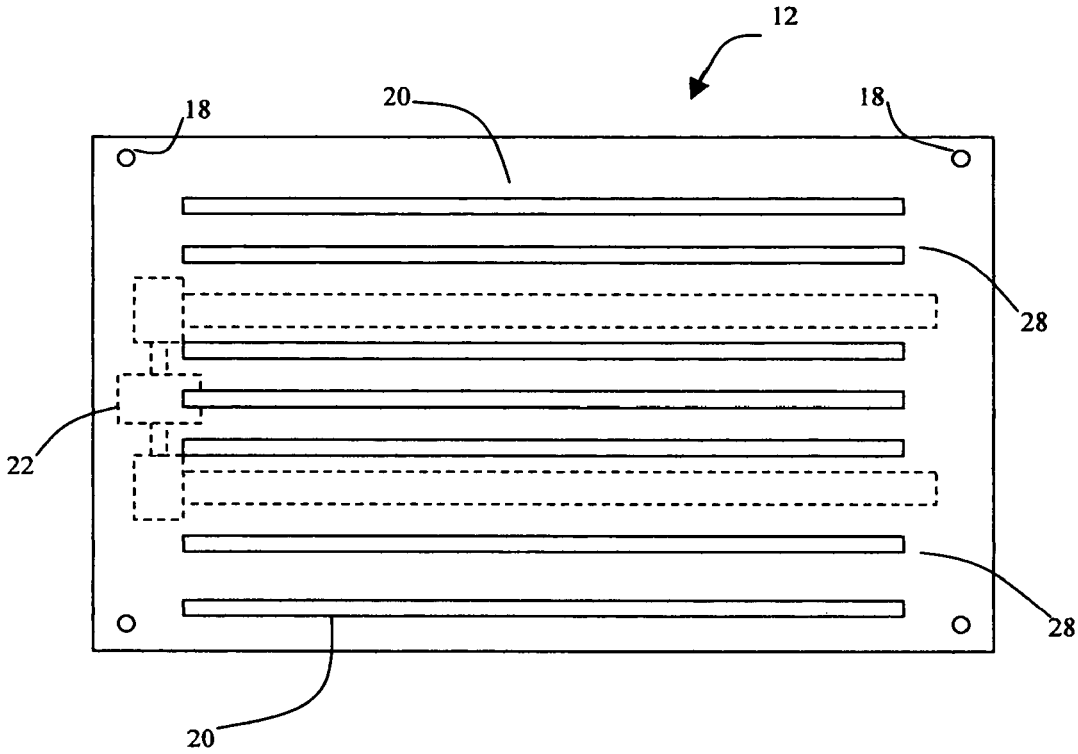
FIG. 6 is a top plan view of the sleep system powered foundation having mechanically and independently adjustable support members.

In an embodiment shown in FIG. 6, motor 22 and cam 28 can be used to provide actuation power to drive shaft 28 which provides longitudinal positioning for massage actuators 24 and massager 26. Additional motors (not shown) perform other functions such driving massager 26 inboard or outboard or providing vibration. Motor (not shown) may be used to drive an elastic cable system (not shown) to drive mechanical actuator 24 and massager 26, drive shaft 28 and associated motor 22 to hoist this assembly vertically upward to mattress topper 15 and user and provide various compressive forces (massage). Alternative, this elastic cable system (not shown) may be used to lower the massaging assembly away from user, to reduce either gradually or abruptly reduce the massaging pressure. This elastic cable system allows the massaging assembly to follow the counter the user's body. Alternative, air controlled actuators may be alternatively utilized in place of mechanical actuator 24. Likewise, various massaging contacts may be utilized in lieu of massager 26.

One embodiment of an actively adjustable firmness sleep system is shown in FIG. 6 that illustrates powered foundation 14 with support members 20. A motor 22 actuates support members 20 via a camshaft 28. To adjust the firmness of foam mattress 12, a support member 20 is raised which locally compresses mattress body 13. A variety of support members 20 can be utilized along the length of foam mattress 12. Multiple motor 22 and cam systems may be utilized to provide support or softness along the foam mattress 12. Support members 20 may be composed of various materials such as wood, plastic, metal, fiberglass, carbon epoxy and other materials.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

I claim:

1. An apparatus for providing massage and a sleep surface, the apparatus comprising:

a sleep mattress having at least one slit formed therein comprised of a friction reducing material;

a topper portion of the sleep mattress;

at least one massaging member that is receivable in the at least one slit; and a controller for controlling the position of the at least one massaging member; and wherein the at least one slit remains substantially closed until the at least one massaging member is received therein.

2. The apparatus of claim 1 wherein the topper portion of the sleep mattress is comprised of visco-elastic foam.

3. The apparatus of claim 2 wherein the topper portion of the sleep visco-elastic foam portion of the top of the sleep mattress further includes a removable cover.

4. The apparatus of claim 2 wherein the visco-elastic foam portion of the top of the sleep mattress further includes an uninterrupted lateral, top surface.

5. The apparatus of claim 1 wherein the sleep mattress further includes a load-supporting submattress.

6. The apparatus of claim 5 wherein the load-supporting submattress is composed of visco-elastic foam.

7. The apparatus of claim 5 wherein the load-supporting submattress is composed of spring members.

8. The apparatus of claim 5 wherein the load-supporting submattress is composed of a combination of spring members and foam or batting material.

9. The apparatus of claim 5 wherein the at least one slit in the sleep mattress is positioned from the bottom side of the submattress and travels upwards towards the topper portion of the sleep mattress.

10. The apparatus of claim 9 wherein the at least one slit in the sleep mattress is lined with the friction reducing material.

11. The apparatus of claim 1 wherein the friction reducing material comprises polytetrafluoroethylene, silicon, tungsten disulfide or another low friction material.

12. The apparatus of claim 1 wherein the at least one massaging member originates from and is driven by a powered foundation.

13. The apparatus of claim 12 wherein the powered foundation receives information from the controller.

14. The apparatus of claim 12 wherein the powered foundation further includes a track for positioning the at least one massaging member along the length of the powered foundation.

15. The apparatus of claim 14 wherein the powered foundation further includes a motor for moving the at least one massaging member along the track.

16. The apparatus of claim 14 wherein the sleep mattress further includes a submattress and wherein the at least one massaging member travels vertically upward from the powered foundation into the at least one slit of the submattress.

17. The apparatus of claim 14 wherein the at least one massaging member moves in massaging actions.

18. The apparatus of claim 17 wherein the at least one massaging member moves in massaging actions further includes tapping, kneading, vibration or rolling massage movements.

19. The apparatus of claim 14 wherein the at least one massaging member travels to a different location on the track in the powered foundation to engage in massaging action.

20. A powered foundation in combination with a mattress for providing massage, comprising:

the powered foundation comprising:

at least one massaging member;

a track for positioning the massaging member;

a controller controlling the position of the at least one massaging member on the track and controlling massaging movements; and the mattress comprising:

a mattress body having at least one slit formed therein comprised of a friction reducing material; and wherein the at least one massaging member is receivable in the at least one slit in the mattress body and movable relative thereto;

wherein the mattress further comprises a top layer overlying the at least one slit; and wherein the at least one slit remains substantially closed until the at least one massaging member is received therein.

21. The powered foundation and mattress combination of claim 20 wherein the top layer comprises a topper having an uninterrupted laterally extending top surface.

22. The powered foundation and mattress combination of claim 21 wherein the at least one slit is lined with the friction reducing material.

23. The powered foundation and mattress combination of claim 22 wherein the friction reducing material comprises polytetrafluoroethylene, silicon, or tungsten disulfide.

24. An apparatus for providing massage and a sleep surface, the apparatus comprising:

a sleep mattress comprised of a topper portion and a submattress with the submattress having a slit comprised of a friction reducing material and extending toward the topper portion; and a powered foundation comprised of a motor, a track and a movable massaging member that is receivable in the slit in the sleep mattress; and wherein the slit remains substantially closed until the massaging member is received therein.

25. The apparatus of claim 24 wherein the mattress further comprises an uninterrupted laterally extending top surface.

26. The apparatus of claim 25 wherein the slit is lined with the friction reducing material.

27. The apparatus of claim 26 wherein the friction reducing material comprises polytetrafluoroethylene, silicon, or tungsten disulfide.

28. An apparatus for providing massage and a sleep surface, the apparatus comprising:

a mattress having a top surface and a slit extending toward the top surface comprised of a friction reducing material; and a foundation underlying the mattress that is comprised of a movable massaging member that is receivable in the slit in the sleep mattress;

wherein the mattress comprises a topper portion and a submattress;

wherein the slit is formed in the submattress wherein the friction reducing material lines the slit; and wherein the slit remains substantially closed until the massaging member is received therein.

* * * * *